United States Patent [19]

Saquet

[11] Patent Number: 4,572,407

[45] Date of Patent: Feb. 25, 1986

[54] PACKAGING SAFETY MEANS FOR SYPHON TYPE POWDER DISPENSERS

[76] Inventor: Jean-Jacques Saquet, 15, rue Pasteur, F-34500 Beziers, France

[21] Appl. No.: 579,909

[22] PCT Filed: May 16, 1983

[86] PCT No.: PCT/FR83/00093

§ 371 Date: Jan. 25, 1984

§ 102(e) Date: Jan. 25, 1984

[87] PCT Pub. No.: WO83/04169

PCT Pub. Date: Dec. 8, 1983

[30] Foreign Application Priority Data

May 25, 1982 [FR] France ..... 82 09001

[51] Int. Cl.[4] ..... B67B 7/24

[52] U.S. Cl. ..... 222/83; 222/633; 222/541; 222/211

[58] Field of Search ..... 383/906; 206/603, 219; 220/265, 277; 222/81, 83, 89, 211, 213, 541, 631–633

[56] References Cited

U.S. PATENT DOCUMENTS

| | | | |
|---|---|---|---|
| 459,915 | 9/1891 | Ludde | 222/211 |
| 1,545,480 | 7/1925 | Boyle | 222/211 |
| 1,909,209 | 5/1933 | Miller | 222/81 |
| 2,725,161 | 11/1955 | Browning . | |
| 4,221,291 | 9/1980 | Hunt | 222/83 |

FOREIGN PATENT DOCUMENTS

| | | | |
|---|---|---|---|
| 2457994 | 6/1976 | Fed. Rep. of Germany | 220/277 |
| 529861 | 11/1940 | United Kingdom . | |

*Primary Examiner*—H. Grant Skaggs

*Attorney, Agent, or Firm*—Burns, Doane, Swecker & Mathis

[57] ABSTRACT

A disposable, hermetically sealed dispensing container for pulverulent material is described. The dispensing container has a domed flexible body portion opposite a base portion to which an axial flow pipe is attached. A thin plug seals an opening in the axial flow pipe and is punctured at the time of use.

5 Claims, 4 Drawing Figures

PACKAGING SAFETY MEANS FOR SYPHON TYPE POWDER DISPENSERS

The invention herein relates to anti-humidity powder dispensers using the syphon principle for flowing out the product they contain.

Since 1928, several patents have been registered under the following numbers:

FR.A. No. 786 176 (1935)
DE.A. No. 2 101 660 (1972)
U.S. Pat. No. 2 237 718 (1939)
U.S. Pat. No. 3 520 446 (1970)
FR.A. No. 733 672 (1932)
U.S. Pat. No. 1 718 684 (1928)
U.S. Pat. No. 1 919 280 (1931)
FR.A. No. 59 157 (1953)

In these models, no packaging safety means were provided. This lack precludes their use in disposable packages and suppresses one of the main advantages of this powder dispenser: its low cost price.

The saftey packaging means of the invention thereof make it possible to access this new outlet, this new market which is the largest: that of "disposable packages".

The invention consists in adapting the dispenser in such a way as to obtain a water-proof package by sealing or plugging of the product-flow pipe until the point the dispenser is actuated.

Figure 1:
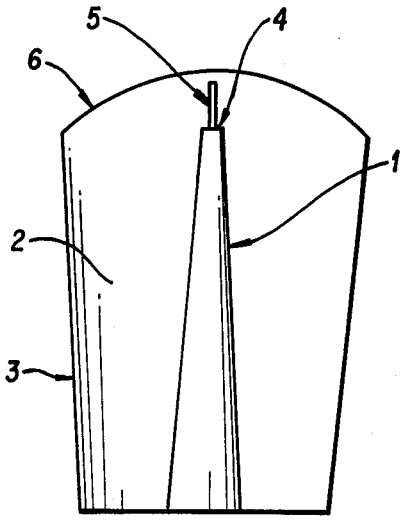

The dispenser is formed of, referring to FIG. 1, a cylinder-shaped or cone-shaped body (3) shut on its upper section by a dome (6) and inside equipped with an axial-flow pipe (1). The matter to be sprayed is contained in the space (2) outlined by the dispenser body and the flow-pipe.

The invention shall be best understood through reference to the figures.

FIG. 1 represents the dispenser and a system for sealing the flow pipe.

Figure 2:
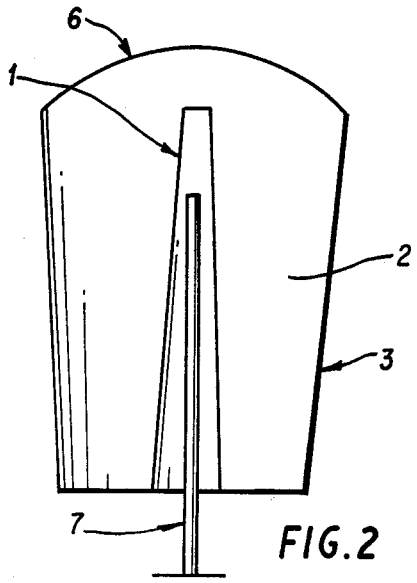
Figure 3:
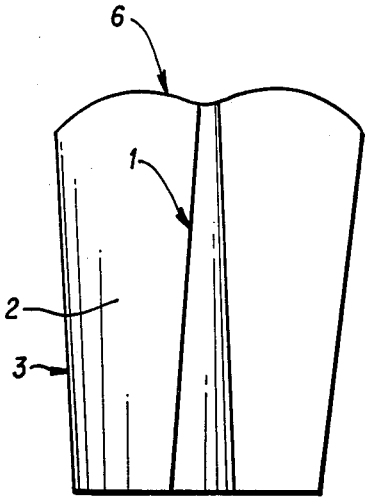
Figure 4:
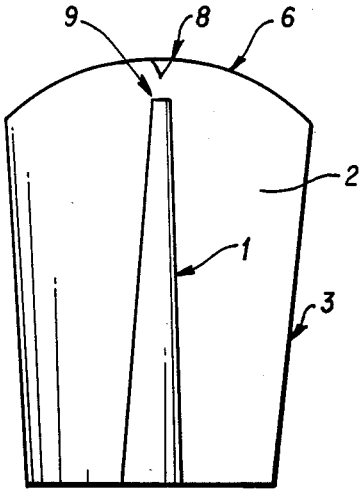

FIGS 2, 3, and 4, represent alternative means for plugging the flow pipe.

According to FIG. 1, the upper section of the flow-pipe (1) is made integral with a rigid pin (5) by a very fine film (4), these three elements (1), (5), and (4), forming a water-proof sealing against the discharge of the product contained in the space (2). Moreover, the dome (6) of the dispenser is a flexible dome in this version, which makes it possible by pressing on it, to lower it till it comes in contact with the pin (5), and by exerting more pressure to break the film (4), thus releasing the opening of the flow-pipe (1) to set the dispenser in action.

In the alternative described in FIG. 2, plugging of the flow-pipe (1) is obtained by means of a pin (7) slipped into the flow-pipe thereof (1) which it will suffice to withdraw in order to actuate the dispenser.

FIG. 3 represents another alternative for plugging the flow-pipe obtained by deforming the flexible dome (6) by partially vacuum-packing the product in the dispenser; the dome (6) bears on the end of the flow-pipe (1) providing its plugging; by simply pressing on the periphery of the flexible dome (6), it will be made to come up again, thus releasing the flow-pipe (1), for starting up the dispenser.

FIG. 4 represents yet another alternative for plugging the flow-pipe (1), obtained by a thin plug (9) located on its end part. The dome (6) is equipped with a pin (8) located in the axis of the flow-pipe. By pressing on the flexible dome (6), this pin breaks the plug open (9), thus releasing the opening of the flow-pipe (1).

Any equivalent technical means for obtaining the plugging of the flow-pipe, shall be part of and covered by the invention, and thus protected by the patent application.

Syphon-type dispensers equipped as per the invention offer safety packaging which are essential to their use as disposable packages.

I claim:

1. A container for distributing powder contents, comprising:

a frusto-conical body portion having a base, an annular side wall and a flexible domed upper section, said base having a central opening therein;

an elongated axial flow pipe attached to said base and having a first opening adjacent said flexible domed upper section and a second opening adjacent said base;

means including an integral thin plug for temporarily sealing one of said openings in said flow pipe in an air-tight manner so as to protect the contents of the container against deterioration; and means for breaking said sealing means so that the contents can be expelled through said flow pipe under the action of external pressure applied to said container.

2. A container as set forth in claim 1, wherein the means for breaking said thin plug includes a thin axial rod integrally attached to said plug and located above said plug, whereby under external pressure applied to said flexible dome said rod breaks said thin plug and said rod and plug are expelled through said flow pipe.

3. A container as set forth in claim 2, wherein said thin plug is attached to said first opening of said flow pipe.

4. A container as set forth in claim 2, wherein said thin plug is attached to said second opening of said flow pipe.

5. A container as set forth in claim 1, wherein the means for breaking said thin plug is a protuberance attached to said flexible domed upper section and located directly above said thin plug.

* * * * *